US007213782B2

(12) United States Patent
Osborne et al.

(10) Patent No.: US 7,213,782 B2
(45) Date of Patent: May 8, 2007

(54) INTELLIGENT DISPENSING SYSTEM

(75) Inventors: Charles Agnew Osborne, 7255 Gresham Trace, Cumming, GA (US) 30040; Tsu Ling Chang, Worthington, OH (US)

(73) Assignee: Charles Agnew Osborne, Cumming, GA (US)

( * ) Notice: Subject to any disclaimer, the term of this patent is extended or adjusted under 35 U.S.C. 154(b) by 203 days.

(21) Appl. No.: 10/967,976

(22) Filed: Oct. 19, 2004

(65) Prior Publication Data

US 2005/0167541 A1 Aug. 4, 2005

Related U.S. Application Data

(60) Provisional application No. 60/540,633, filed on Jan. 30, 2004.

(51) Int. Cl.
*B65H 26/00* (2006.01)

(52) U.S. Cl. ..... 242/563; 242/564.5

(58) Field of Classification Search ..... 242/563, 242/563.2, 564.5, 393; 700/236, 241, 244; 340/5.9, 5.92

See application file for complete search history.

(56) References Cited

U.S. PATENT DOCUMENTS 4,826,262 A 5/1989 Hartman et al.
4,916,613 A 4/1990 Lange et al.
4,960,248 A 10/1990 Bauer et al.
5,031,258 A 7/1991 Shaw
5,060,877 A * 10/1991 Bullivant ..... 242/564.5
5,781,942 A 7/1998 Allen et al.
5,868,311 A 2/1999 Cretu-Petra
5,878,381 A 3/1999 Gemmell et al.
5,945,910 A 8/1999 Gorra
5,966,753 A 10/1999 Gauthier et al.
6,069,354 A 5/2000 Alfano et al.

(Continued)

FOREIGN PATENT DOCUMENTS

EP 0574372 12/1993

*Primary Examiner*—John Q. Nguyen
(74) *Attorney, Agent, or Firm*—Womble, Carlyle, Sandridge & Rice, PLLC

(57) ABSTRACT

A system and apparatus for automatically dispensing a paper product mounted on a gravity-assisted holder through a dispenser. The apparatus includes an electric motor, a main product roller for automatically rolling a predetermined amount of the paper product from the holder, exit guide rollers for guiding the paper product through a front cover of the dispenser, and a series of interconnected gears that are driven by the electric motor to activate the main product roller and exit guide roller and operate both the main roller and exit roller at the same speed. Operating the rollers at the same speed prevents paper or tissue jamming inside the dispenser. The system monitors usage of each paper product dispenser with each dispenser having a microprocessor controller for determining a corresponding paper product status for the dispenser. Each paper product dispenser communicates with a master network device preferably mounted on a ceiling plane. Paper product status messages are transmitted between each dispenser and master network device unit using a standard data communications protocol. The master network device communicates the paper product status for each individual dispenser to an independent building automation and control network. A central control console that is interoperable with the building automation and control network monitors the status of each paper product dispenser through signals communicated from a master receiver/transmitter unit to the central control console.

38 Claims, 6 Drawing Sheets

U.S. PATENT DOCUMENTS 6,125,482 A 10/2000 Foster
6,179,243 B1 * 1/2001 Granger ..... 242/564.5
6,189,163 B1 2/2001 Van Marcke
6,236,953 B1 5/2001 Segal
6,250,601 B1 6/2001 Kolar et al.
6,317,717 B1 11/2001 Lindsey et al.
6,411,920 B1 6/2002 McConnell et al.
6,419,136 B2 7/2002 Formon et al.
7,044,421 B1 * 5/2006 Omdoll et al. ..... 242/564.4
2002/0109035 A1 8/2002 Denen et al.
2002/0150198 A1 10/2002 Thompson et al.
2003/0222779 A1 12/2003 Schotz et al.

* cited by examiner

INTELLIGENT DISPENSING SYSTEM

CROSS-REFERENCE TO RELATED APPLICATION

The present patent application is a formalization of a previously filed, co-pending provisional patent application entitled "Automatic Dispensing System", filed Jan. 30, 2004, as U.S. Patent Application Ser. No. 60/540,633 by the inventor named in this patent application. This patent application claims the benefit of the filing date of the cited provisional patent application according to the statutes and rules governing provisional patent applications, particularly 35 U.S.C. § 119(e)(1) and 37 CFR §§ 1.78(a)(4) and (a)(5). The specification and drawings of the provisional patent application are specifically incorporated herein by reference.

BACKGROUND OF THE INVENTION

The present invention relates generally to systems for dispensing and, more particularly, to intelligent systems for automatically dispensing measured amounts of paper products and monitoring usage.

The dispensing of paper products has resulted in many different types of dispensing devices for controlling quantities dispensed as well as for determining how efficiently the paper products are dispensed. Primarily, these dispensers use mechanical paper feeding mechanisms, actuated by the user physically touching the dispenser equipment to deliver a fixed length of paper. This bodily contact can raise concerns over hygiene when such dispensers are located in public restroom facilities. Additionally, out of paper or paper jam conditions have to be determined by visual inspection, requiring periodic inspections by custodial staff.

SUMMARY OF THE INVENTION

The present invention relates to a hybrid mechanical and electronic device for dispensing paper products. In particular, the invention applies to devices for dispensing paper towels and toilet tissue. Normal building current or an internal rechargeable battery powers the circuitry. The device integrates a microcomputer, coupled with electronic controls and sensors, to dispense paper, monitor the paper usage and mechanism status, and report paper usage and machine status.

Each dispenser control can have a data communications network interface. The network allows the dispenser status to be monitored on a continuous basis from any number of remote terminals, including handheld computing devices. This ability to monitor the usage and status of each paper dispenser yields greater user satisfaction. The custodial staff can maintain the dispenser in proper service condition with minimal down time by having instant notification of paper outages or malfunctions.

In one aspect of the invention, an apparatus is provided for automatically dispensing a paper product mounted on a gravity-assisted holder within a dispenser. The apparatus includes an electric motor, a main feed roller for automatically rolling a predetermined amount of the paper product from the holder, an exit guide roller for guiding the paper product through a front cover of the dispenser, and a series of interconnected gears between the main feed roller and exit guide roller that are driven by the electric motor.

In another aspect of the invention, an electronic control system is provided for automating the dispensing of product and monitoring usage as well as enabling system status retrieval via a communications network. The electronic control system includes a microprocessor and associated application program, an electrical interface linking sensors and actuators to the microprocessor, the motor and sensors, and a network interface connecting the processor to the network media.

Each dispenser with its associated network interface and application program forms one device within a bi-directional local communications network. Connection to this network can be via one or more media types; e.g., wire, radio frequency (RF) or infrared (IR). The dispenser status and monitored values are converted to digital form and the data is transmitted via the network. Additionally, configuration parameters for the operation of the dispenser can be received via the network. A collection of dispensers communicates over this network to a master network device that acts as the server for the local network. The master device interprets the data and manipulates it for rebroadcast to a separate and independent building automation network. The master device thus acts as a gateway between the local dispenser network and any other network protocol. The master device can also broadcast to a handheld computing device using the same or different network media type.

BRIEF DESCRIPTION OF THE DRAWINGS

The invention is better understood by reading the following detailed description of the invention in conjunction with the accompanying drawings.

DETAILED DESCRIPTION OF THE INVENTION

The following description of the invention is provided as an enabling teaching of the invention in its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

The invention provides a mechanism for automatically controlling the dispensing of paper products. Although the embodiment disclosed herein is a system for dispensing paper towels and toilet tissue in facilities such as restrooms, the concepts are applicable to other types of automatic paper dispensing and metering applications. The embodiment disclosed herein is particularly suited for use in buildings having multiple restrooms distributed over multiple floors where the intelligent dispensing network system (IDNS) detects and reports empty dispensers, paper levels, paper jams, power levels, losses, and vandalism. Real time monitoring of each dispenser system allows total control of an entire facility's washroom paper requirements.

Figure 1:
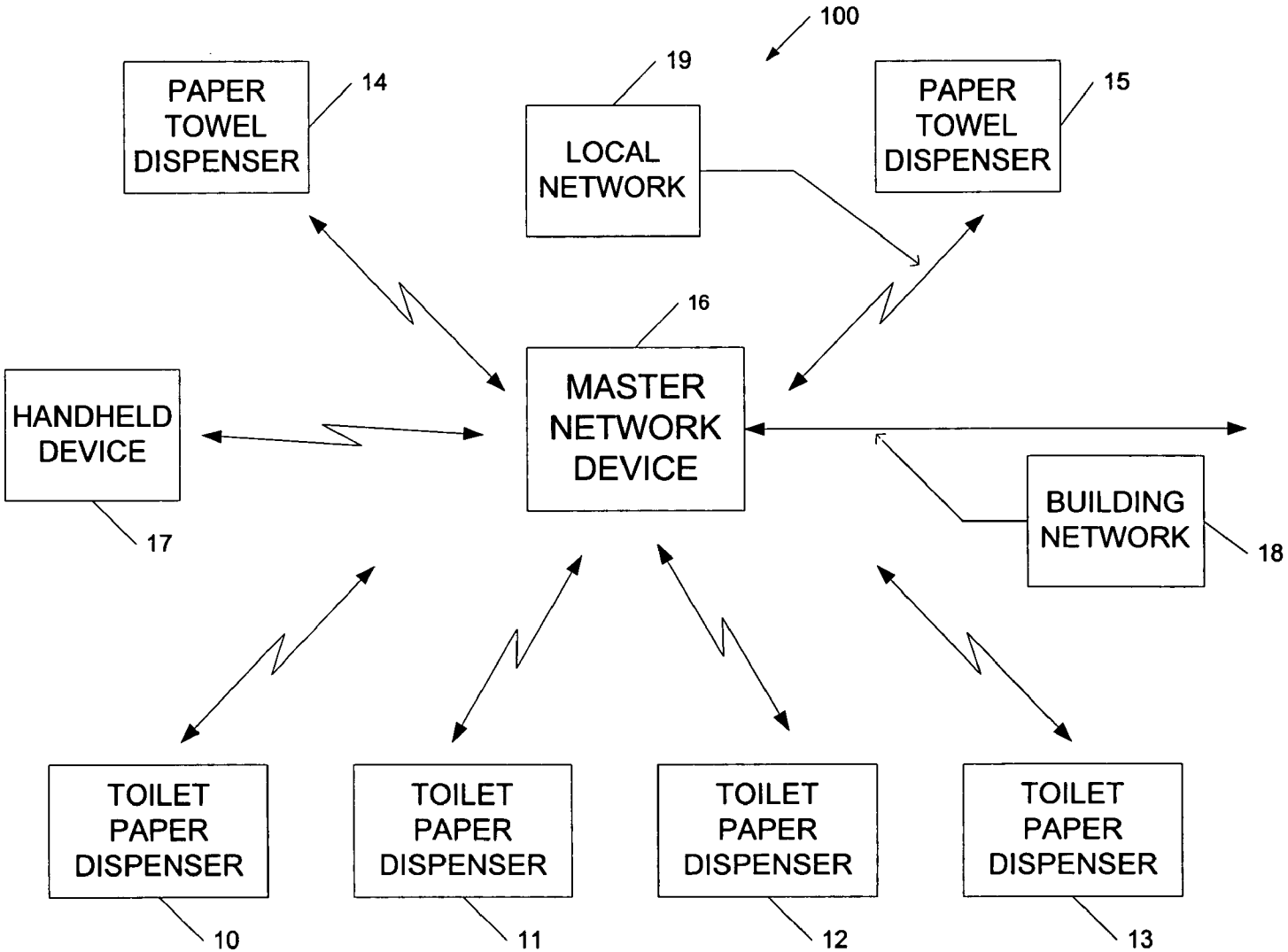
FIG. 1 illustrates a physical and logical layout for the automatic dispensing system in accordance with an exemplary embodiment of the present invention.

FIG. 1 illustrates the layout of the intelligent dispenser network system (IDNS) 100 for automatic monitoring and dispensing in an exemplary embodiment. This layout exemplifies a simple installation scenario, although other, more complex arrangements and combinations are possible and within the scope of the invention. The IDNS 100 is a collection and combination of the intelligent dispensers 10–15, master network device 16, and handheld device 17. This collection of dispensers 10–15 and master network device 16 forms a local dispenser network 19 and can be confined to a specific washroom or other area requiring the dispensing system. With the selection of the appropriate communications medium, other rooms some distance away can be added to the local network; for example, adjacent men's and women's washrooms. Multiple local IDNS networks 100 can be coupled to a building network 18 through the master network devices 16.

The network communications media (i.e., the data signal path) between the master network device 16 and the dispensers 10–15 can be wire, radio frequency (RF) or infrared (IR). The network medium is selected to yield the highest network performance given the architectural construction and limitations of the space. The communications protocol used with the local dispenser network can be a proprietary method or one of many recognized standard protocols.

Figure 3:
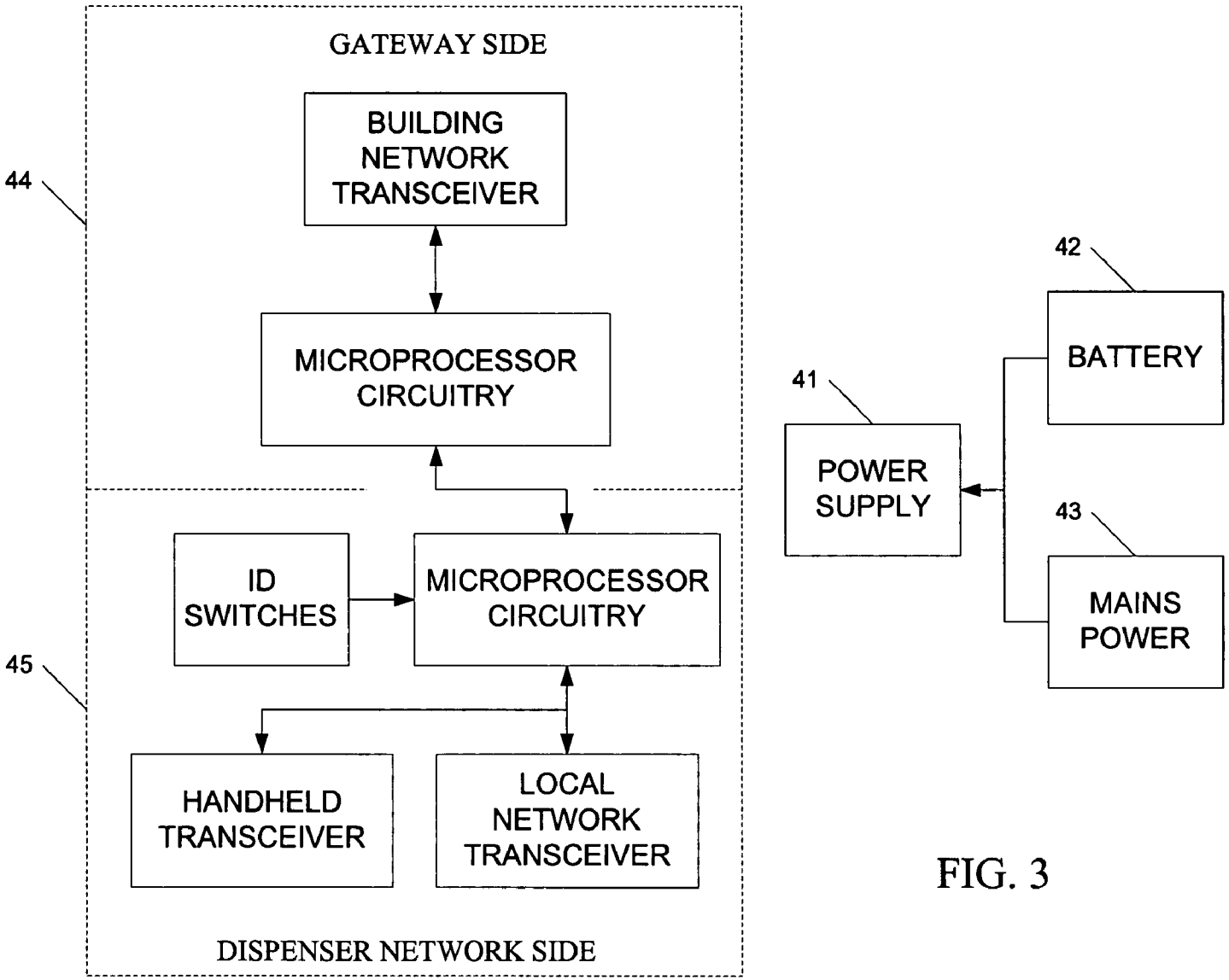
FIG. 3 illustrates a block diagram of the master network device for the automatic dispensing system in accordance with an exemplary embodiment of the present invention.

The intelligent dispensing network system 100 has a master network device 16 usually attached to a ceiling plane or in close proximity to the group of dispensers 10–15. It is situated to yield the best signal strength when using RF or IR transceivers. The master network device 16 provides the common data collection point (the server) for the dispenser units 10–15 located in the local network area 19. FIG. 3 illustrates, in block diagram form, the components of the master network device 16. One section of the master network device 16 is the network server 45 for the local IDNS. This processor is responsible for requesting and receiving dispenser status and parameter data sent via the local network 19. The transmitted data is interpreted and presented to a second processor 44 which forms a gateway connection to the building network 18. The primary purpose of the gateway is to convert one communications protocol to another. With this method of interfacing different networks, the IDNS can be adapted to support existing and future standard networks commonly used in building automation systems.

Another feature of the master network device 16 is a separate transceiver to support use of a handheld computing device 17. This device can be a PDA, portable computer, or other display/keypad terminal. The communication medium between the master device network 16 and the handheld device 17 can be of a non-contact nature; such as RF or IR, or can be by a wired method, such as an Ethernet network interface or RS-232 connection. The medium and protocol can be different from that of the IDNS 100 and building automation network allowing greater flexibility in selecting a handheld device 17 to meet the consumers' needs.

Figure 2:
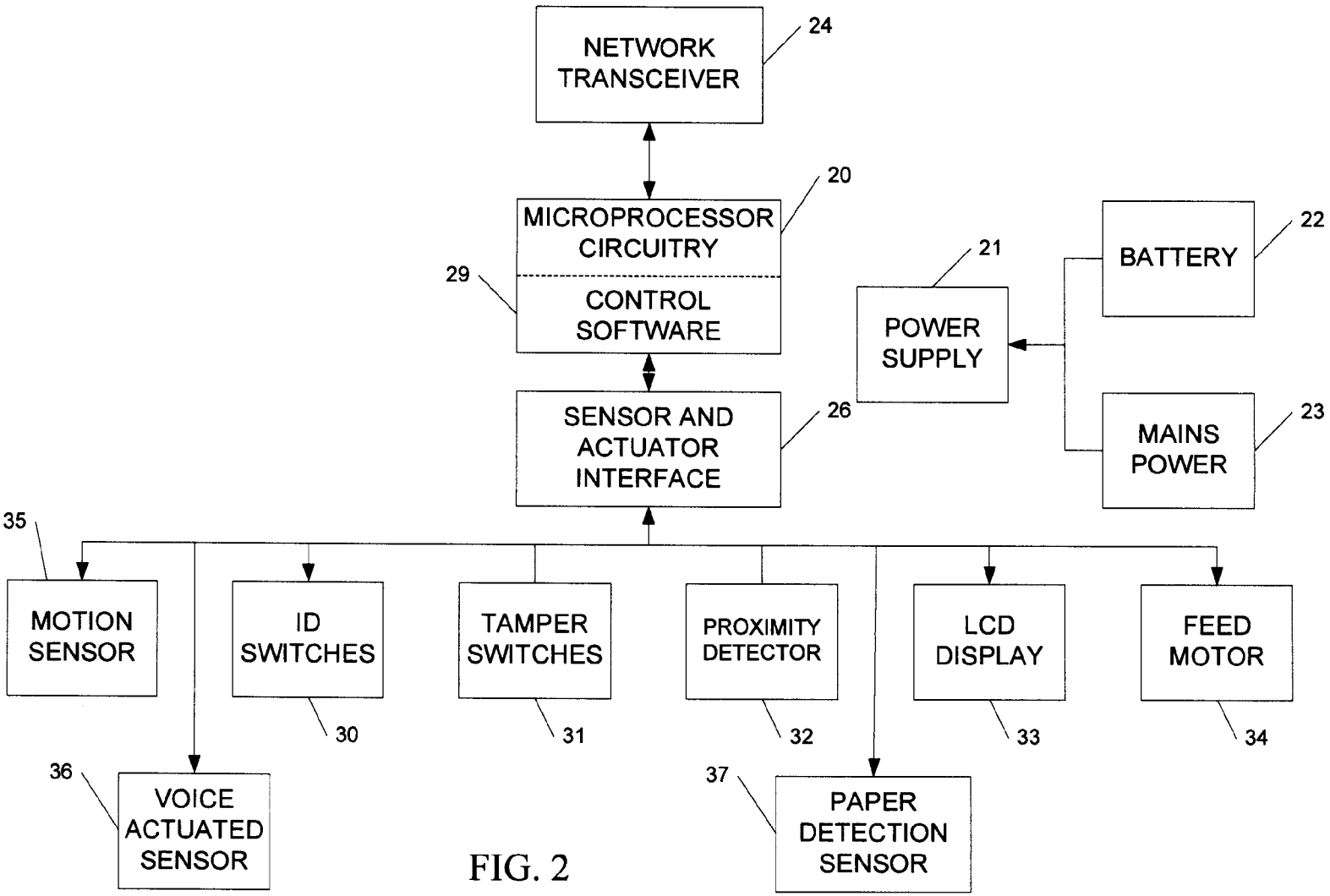
FIG. 2 illustrates block diagram of the electronic control system contained within the dispenser in accordance with an exemplary embodiment of the present invention.

The electronic control system (controller) illustrated in FIG. 2 is responsible for controlling, monitoring, and reporting the operation of the dispensers 10–15. A microprocessor 20 executes an application specific program. The processor has interface circuitry 26 to adapt the signals of the dispenser sensors and actuators, converting these control signals to the proper voltage levels. The sensors 30, 31, 32 represent a collection of input devices used to detect a user request for paper, measure the length of paper fed, sense the position or misfeed of the paper, enter a setting for the dispenser network address, and detect unauthorized opening or tampering of the enclosure. The actuators represent a collection of output devices to operate the feed roller motor 34, and output textual status messages to an LCD display 33. The transceiver circuit 24 provides the interface between the local network media (wire, RF, or IR) and the voltage levels of the microprocessor 20. A power supply 21 is used to convert either main current and/or battery power to the appropriate levels for the electronic circuitry.

The automatic paper roll towel dispensers 14, 15 are battery powered and/or AC adapted. Use of a battery eliminates the need to make modifications to the structure to install power wiring, thus reducing installation costs to the consumer. A replaceable and rechargeable battery (e.g., lithium ion) can be used and sized for the power demand of the intelligent dispenser's electronics. Battery life expectation is calculated to be approximately two to six months depending on usage. A sleep mode can be activated during unoccupied hours to prolong battery life.

For both types of paper product dispensers, an IR sensor mounted in the front panel of the dispenser senses the presence of a person in proximity to the dispenser. The LCD panel can then prompt the person to voice-activate (VA) the dispenser in order to dispense the product. VA can be disengaged (on/off capability) and a motion sensor dispensing activator can trigger product dispensing. The microprocessor collects and calculates the dispenser data and status and transmits the data. Each paper towel dispenser 14, 15 and/or tissue dispenser 10, 11, 12, 13 has an addressable code to uniquely identify it.

For both paper towel and tissue dispensers, the readout on the LCD panel provides an indication of power status and paper status. The power status indicator provides a measure of the battery power and provides a warning of low battery. The paper status indicator shows the paper usage and status, such as paper jam, out of paper, etc. Once the presence detector is activated by someone positioned in front of the dispenser, the LCD can illuminate and prompt the user to say either "towel" or "tissue" in order to dispense the paper towel or tissue. Alternatively, the user can locate his hand under the dispenser 10–15 to dispense the paper.

In an exemplary embodiment, selectable pins or toggle switches inside the dispenser can be used to set sensing distance and length of paper to dispense. As an example, the sensing distance (to detect the presence of a user) could be set to be (1) less than or equal to 30 mm. or (2) less than or equal to 60 mm. The length of paper to dispense could be set to 8 inches, 12 inches or 16 inches. These distances and lengths are design considerations for a particular installation and other settings can be used as appropriate. The paper dispenser is not active when the dispenser cover is opened. Alternatively, these operational parameters may be set individually with instructions sent via the network.

After detecting the presence of a hand and dispensing paper, the dispenser will not dispense additional paper until after the previously dispensed paper is torn off from the dispenser. A sensor mounted at the discharge throat detects the presence of paper after each dispensing. If no paper is detected, there could be a paper jam inside the dispenser, the paper could be broken, or the paper could be completely used up. The dispenser will stop working if any of these conditions occur. This paper jam condition can be reported to the network and indicated locally on the LCD display.

Figure 6A:
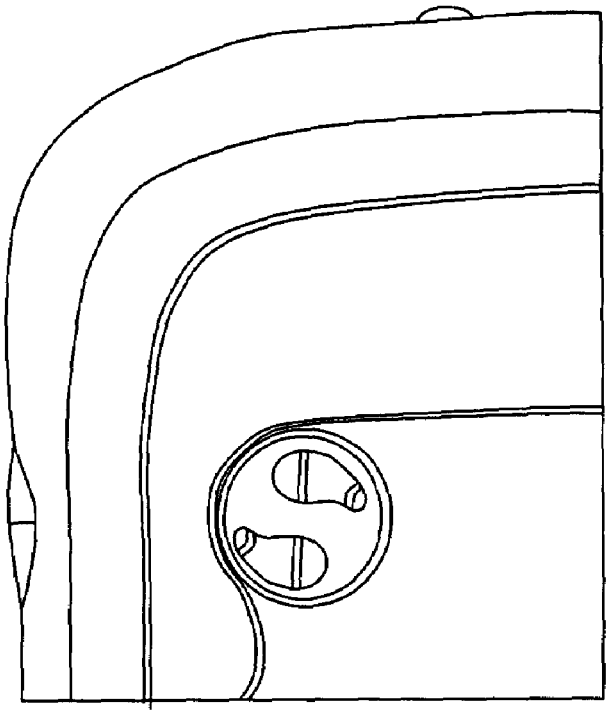
FIGS. 6A and 6B illustrate a side and front view of a dispenser cover having a liquid crystal display (LCD) panel for showing battery and paper status in accordance with an exemplary embodiment.
Figure 6B:
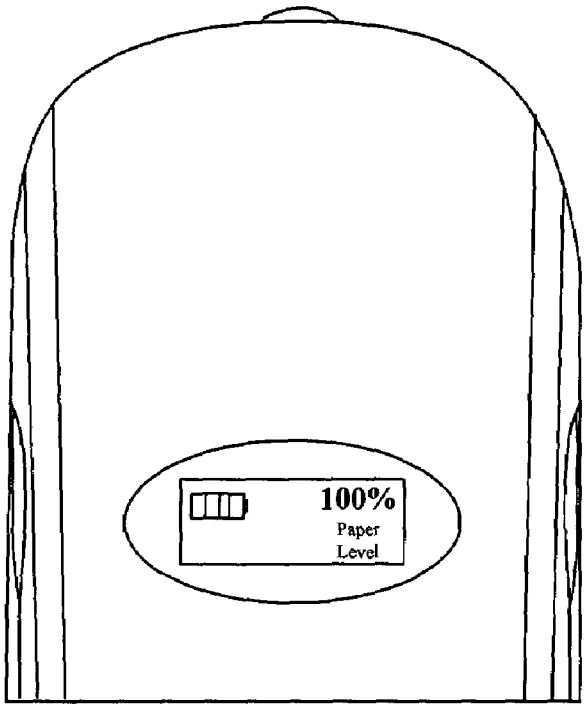

FIGS. 6A and 6B illustrate a side and front view of a dispenser cover having an LCD panel for showing battery status and paper status. When a paper roll is installed within either the paper towel or tissue dispenser, the LCD display will indicate 100% on all size paper rolls. The percent remaining will automatically be sensed and the LCD readout changed as the installed paper is used. In an exemplary embodiment, the LCD will provide a preliminary warning indicating that the remaining paper has reached 20%. When the LCD readout shows 0%, the dispenser will provide an out-of-paper warning. However, the dispenser will stop working only when the sensor at the discharge throat fails to detect paper after each discharge. The percent of paper remaining and out-of-paper conditions can be reported to the network.

The LCD remaining paper display, in an exemplary embodiment, will decrease in 1% intervals from 100% when the paper roll is installed to 0% when it is determined by a microprocessor controller that the paper roll is empty. A battery usage indicator on the LCD display includes a battery symbol and a number of bars (e.g. 4 bars) to indicate the remaining charge, in a manner similar to cell phone battery charge displays. The LCD display will display an alarm when the battery needs to be changed or charged. The LCD display will normally be a ready mode indication. During normal working conditions, the LCD display will show the battery charge remaining and the paper remaining in the dispenser. During abnormal working conditions, there could be a battery alarm, a paper remaining at 20% warning, an end of paper alarm or a paper stopped alarm when there is a paper jam or broken paper inside the dispenser.

A PDA 17 or similar device with a supported transceiver can be used to retrieve data from any floor, area, and room having a master network device 16. The handheld device 17, such as a PDA, is brought within transmission distance of the master network device 16. Bi-directional communications is possible to download current dispenser status and upload dispenser operational parameters.

Figure 4:
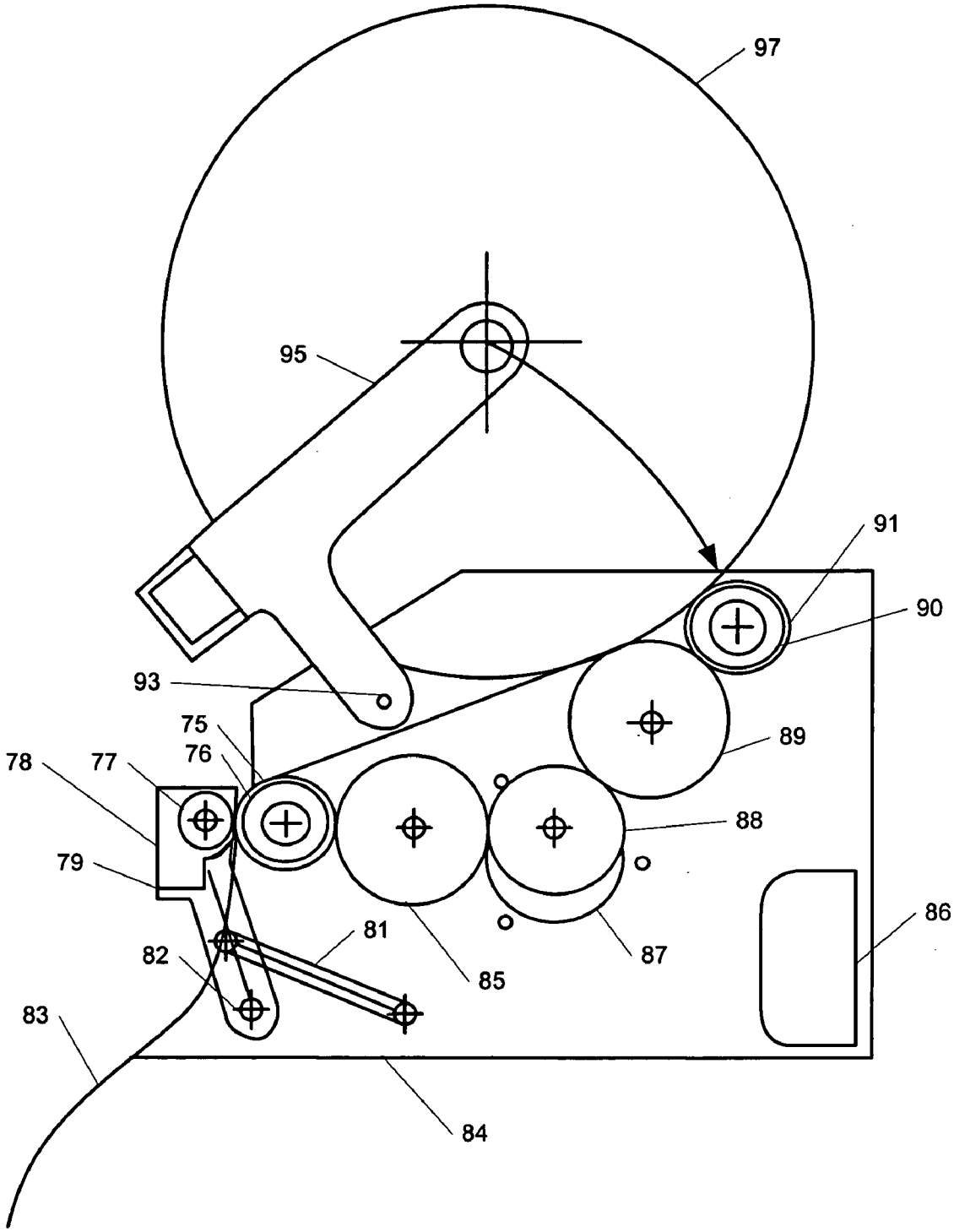
FIG. 4 illustrates a gravity-assisted roll feed mechanism in accordance with an exemplary embodiment of the present invention.

As illustrated in FIG. 4, an electric motor 87 and the associated gears 76, 85, 88, 89, 90 turn the main product roller 91 and the exit rollers 75, 77 simultaneously for towel evacuation. The main product roller 91 rolls the actual paper 97 while the exit rollers 75, 77 guide the paper 97 through the front cover of the dispenser opening for presentation to the user. The gravity assisted roll and feed mechanism of the invention dispenses the paper towel 97 in a manner that is quite different from the prior art. The prior art requires that the towel must be pulled from the actual paper roll utilizing only an exit roller. The roll and feed mechanism of the invention allows the paper towel to be rolled automatically and fed to the user more efficiently. The towel length dispensed is adjustable and metered by the main product roller 91. The amount of towel and battery usage is recorded and monitored in "real time". The amount of paper towel 97 remaining as well as battery life and dispenser open/closed status are displayed on a liquid crystal display (LCD) on the front panel of the dispenser.

The automatic toilet tissue dispensers have the same dispensing mechanism as used in the automatic paper towel dispensers. In fact, the disclosed dispensing mechanism can be used to dispense a wide variety of paper products including wet towels. The automatic toilet tissue dispensers 10, 11, 12, 13 are battery powered and/or AC adapted a replaceable and rechargeable battery can be used and sized for the power demand of the dispenser electronics. The gravity assisted roll and feed mechanism of the invention allows automatic dispensing of tissue 97 unlike that used in the prior art. The prior art requires that the tissue is manually dispensed. Thus the roll and feed mechanism of the invention allows even a single ply tissue to automatically be rolled and fed to the user efficiently without tearing. As is the case for the automatic paper roll towel dispenser, the tissue length dispensed is adjustable and metered by the main product roller 91. The amount of tissue and battery usage is recorded and monitored in "real time". The amounts of tissue remaining as well as battery life and dispenser status open/closed are displayed on the liquid crystal display (LCD). In an exemplary embodiment, all data can be configured using the BACnet communications protocol although this does not limit the invention in any way. Other communications protocols can be used as well and without restricting the invention in any way.

With further reference to FIG. 4, the gravity-assisted roll feed mechanism of the invention uses an electric motor 87 in dispenser 84 to turns the series of gears which activates the main product roller 91 and exit guide rollers 75, 77. The main product roller 91 and exit guide rollers 75, 77 operate at the same speed to ensure paper uniformity during evacuation eliminating product over spin which leads to lower incidence of product misfeeding and or jamming. The towel holder 95 and axis 93 maintain a consistent friction coefficient between the main product roller 91 and the towel/tissue 97 (as the diameter/weight of the product changes) by changing the angle of the paper 97 as applied to the main roller 91. The towel holder 95 is equipped with bearings (not shown) for more efficient rolling and less paper dust. The gravity assist roll and feed mechanism utilizes the gravity as "free energy" to create the friction required to roll the product 97 on the main roller 91 limiting the friction required to feed the product by the exit rollers 75, 77, hence providing a more efficient and consistent way to dispense paper. Consistent coefficient of friction in the present context does not mean a constant coefficient of friction between the roll of paper and main roller. It simply means that as the roll of paper is dispensed, the coefficient of friction does not make any radical or extreme changes.

As further illustrated in FIG. 4, motor 87 drives motor gear 88. Motor gear 88 drives middle gears 85, 89. Middle gear 89 drives gear 90 for the paper main roller 91. Middle gear 85 drives gear 76 for paper exit rollers 75, 77. The paper dispensed 83 (also referred to as "outing" paper) is roll fed by gear 76 between the pressing roller 77 and the outing roller 75. Saw 79 cuts the dispensed paper 83. The pressing roller 77 is supported by pressing roller holder 78 which is mounted on axis 82 and is actuated by spring 81. Also illustrated is battery compartment 86.

Figure 5B:
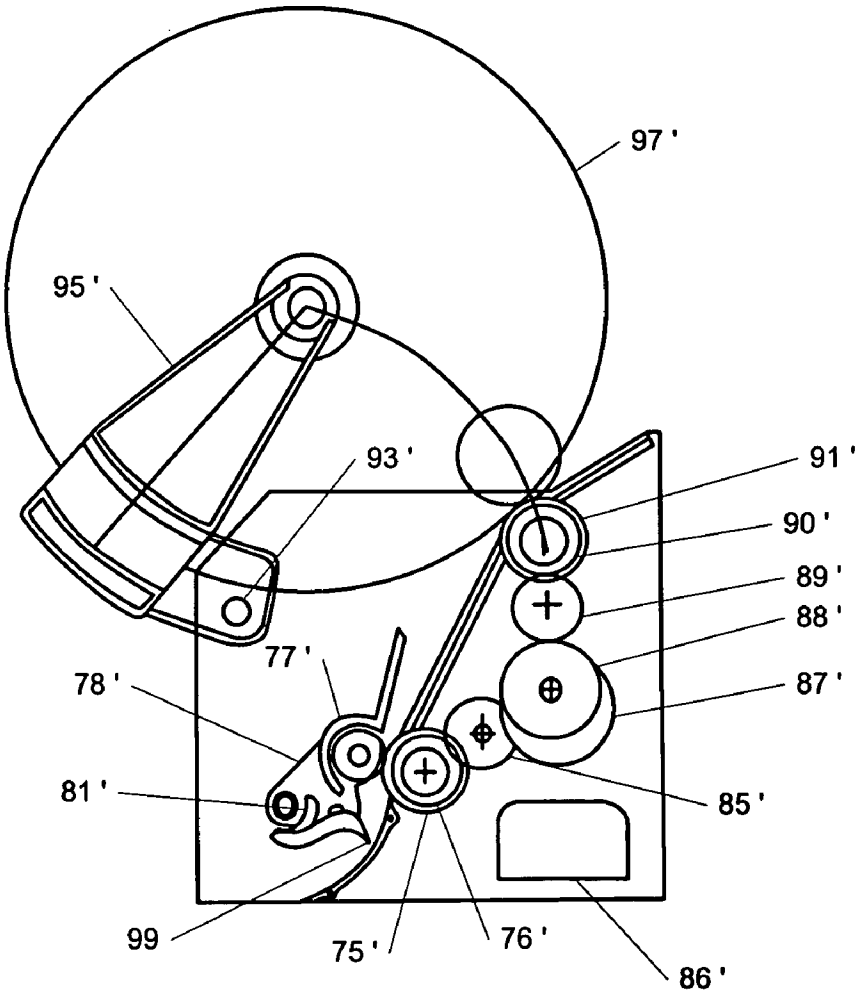
FIGS. 5A–5B illustrate an alternate embodiment of the gravity assisted roll feed mechanism of the present invention.
Figure 5A:
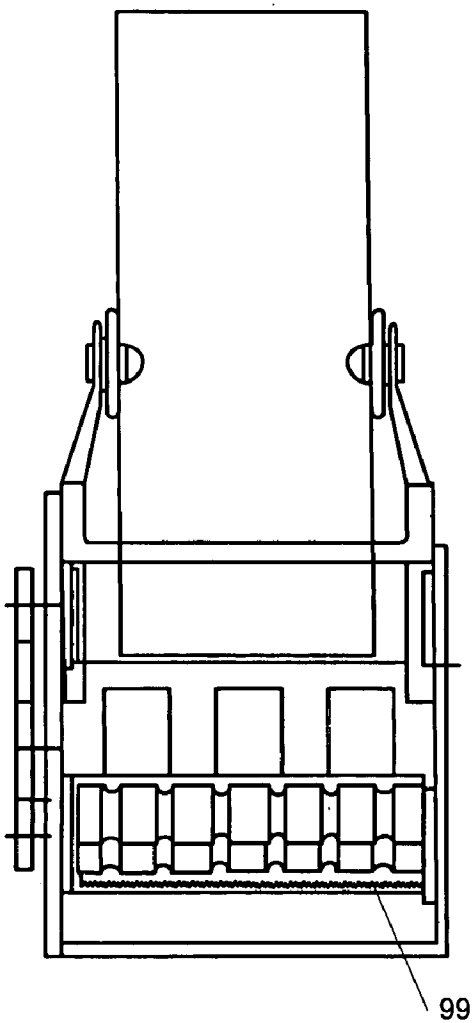

FIGS. 5A–5B illustrate an alternate embodiment of the present invention in which the main roller 91', middle gear 89', main roller gear 90' and motor 87' are aligned in a more vertical orientation. In this figure, reference numerals for similar or identical components as shown in FIG. 4 are marked with a prime superscript. Combined with middle gear 85', exit roller gear 76' and exit rollers 75', 77', a more vertically inclined path is followed by the paper product leading to a lower probability of a paper jam inside the dispensing apparatus. Pressing roller 77' is supported by pressing roller holder 78' and actuated by torsion spring 81'. Serration plate 99 cuts the dispensed paper.

Those skilled in the art will appreciate that many modifications to the exemplary embodiments of the present invention are possible without departing from the spirit and scope of the present invention.

What is claimed:

1. An apparatus for automatically dispensing a paper product, comprising:

a dispenser for dispensing the paper product;

a holder for mounting and guiding a roll of the paper product inside the dispenser, the holder attached to a pivot at one end thereof, about which the holder rotates as the paper product is dispensed;

an electric motor mounted inside the dispenser for activating the dispensing of the paper product from the roll;

a product roller providing a single peripheral surface of contact with the roll of paper product for automatically dispensing a predetermined amount of the paper product from the roll wherein the peripheral surface of contact between the roll of paper product and the product roller changes under gravitational assistance as an amount of remaining paper product on the roll decreases the contact between the roller and the roll being the only contact on the peripheral surface of the roll;

an exit guide roller for guiding the dispensed paper product through a front cover of the dispenser; and a plurality of interconnected gears mounted inside the dispenser that are driven by the electric motor to activate the product roller and exit guide roller and operate each roller at the same speed to prevent misfeeding or jamming of the paper product.

2. The apparatus for automatically dispensing a paper product of claim 1 wherein the holder operates under gravity-assistance as the amount of paper product remaining on the holder decreases to maintain a consistent coefficient of friction between the product roller and the roll of paper product.

3. The apparatus for automatically dispensing a paper product of claim 2 wherein the angle of the paper product holder relative to the product roller changes as a radius of the roll of paper product decreases with each dispensing of paper product.

4. The apparatus for automatically dispensing a paper product of claim 1 wherein the plurality of interconnected gears includes a motor gear, a pair of middle gears driven by the motor gear, a product roller gear driven by a first middle gear, and an exit roller gear driven by a second middle gear.

5. The apparatus for automatically dispensing a paper product of claim 1 further comprising a battery for providing electrical power to the electric motor.

6. The apparatus for automatically dispensing a paper product of claim 5 wherein the battery is a rechargeable lithium ion battery.

7. The apparatus for automatically dispensing a paper product of claim 1 wherein the dispenser comprises a cover and a liquid crystal display panel located on the cover.

8. The apparatus for automatically dispensing a paper product of claim 7 wherein the liquid crystal display panel provides an indication of a battery charge status and a paper product status.

9. The apparatus for automatically dispensing a paper product of claim 1 further comprising a voice actuated sensor and controller for controlling the dispensing of paper product in response to a user command.

10. The apparatus for automatically dispensing a paper product of claim 1 further comprising a motion sensor to detect the presence of a user's hand below the dispenser for controlling the dispensing of paper product.

11. The apparatus for automatically dispensing a paper product of claim 1 further comprising a sensor to detect an end of paper product condition.

12. The apparatus for automatically dispensing a paper product of claim 1 further comprising a microprocessor controller for determining an amount of paper product remaining on the holder and transmitting a data message signal containing a status of the paper product dispenser.

13. The apparatus for automatically dispensing a paper product of claim 12 wherein the data message is transmitted using a standard data communications protocol.

14. The apparatus for automatically dispensing a paper product of claim 13 wherein the data communications protocol is a building automation and control network protocol.

15. The apparatus for automatically dispensing a paper product of claim 12 wherein the data message signal is an infrared signal.

16. The apparatus for automatically dispensing a paper product of claim 12 wherein the data message signal is a radio frequency (RF) signal.

17. An intelligent dispensing system for automatically dispensing and monitoring usage of a paper product dispensed within a building facility, comprising:

a plurality of automatic paper product dispensers, with each dispenser including:

a microprocessor controller;

a transceiver;

a holder for mounting and guiding a roll of the paper product inside the dispenser, the holder attached to a pivot at one end thereof, about which the holder rotates as the paper product is dispensed; and a driven product roller providing a single peripheral surface of contact with the roll of paper product wherein the peripheral surface of contact between the roll of paper product mounted on the holder and the product roller changes under gravitational assistance as an amount of remaining paper product on the roll decreases the contact between the roller and the roll being the only contact on the peripheral surface of the roll;

a master network device located in proximity to the plurality of automatic paper product dispensers and interoperable with the transceiver in each dispenser; and a local network for enabling a data communications paper product dispenser status message to be transmitted between each automatic paper product dispenser and the master network device.

18. The intelligent dispensing system of claim 17 further comprising a building automation and control network interoperable with the local network for monitoring a status of each paper product dispenser.

19. The intelligent dispensing system of claim 18 wherein the master network device transmits status messages over the building automation and control network.

20. The intelligent dispensing system of claim 17 wherein the master network device receives status messages from the transceiver in each dispenser.

21. The intelligent dispensing system of claim 17 wherein each automatic paper product dispenser and the master network device communicate with each other using infrared signals.

22. The intelligent dispensing system of claim 17 wherein each automatic paper product dispenser and the master network device communicate with each other using radio frequency (RF) signals.

23. The intelligent dispensing system of claim 17 wherein the master network device and dispenser transceiver use a wired connection for communication.

24. The intelligent dispensing system of claim 17 wherein each product roller automatically rolls a predetermined amount of the paper product from the holder; each automatic paper product dispenser further comprising:

an exit guide roller for guiding the paper product through a front cover of the dispenser; and a motor and gearing to activate and control operation of the product roller and the exit guide roller.

25. The intelligent dispensing system of claim 24 wherein the holder operates under gravity-assistance as the amount of paper product remaining on the holder decreases to maintain a consistent coefficient of friction between the product roller and the roll of paper product.

26. The intelligent dispensing system of claim 25 wherein the angle of the paper product holder relative to the product roller changes as a radius of the roll of paper product decreases with each dispensing of paper product.

27. The intelligent dispensing system of claim 24 wherein the gearing comprises a motor gear, a pair of middle gears driven by the motor gear, a product roller gear driven by a first middle gear, and an exit roller gear driven by a second middle gear.

28. The intelligent dispensing system of claim 24 further comprising a battery for providing electrical power to the motor.

29. The intelligent dispensing system of claim 28 wherein the battery is a rechargeable lithium ion battery.

30. The intelligent dispensing system of claim 24 wherein each automatic paper product dispenser further comprises a voice actuated sensor and controller for controlling the dispensing of paper product in response to a user command.

31. The intelligent dispensing system of claim 24 wherein each automatic paper product dispenser further comprises a motion sensor to detect the presence of a user's hand below the dispenser for controlling the dispensing of paper product.

32. The intelligent dispensing system of claim 24 wherein each automatic paper product dispenser further comprises a sensor to detect an end of paper product condition.

33. The intelligent dispensing system of claim 17 wherein each automatic paper product dispenser comprises a cover and a liquid crystal display panel located on the cover.

34. The intelligent dispensing system of claim 33 wherein the liquid crystal display panel provides an indication of a paper product status.

35. The intelligent dispensing system of claim 17 wherein the microprocessor controller for each paper product dispenser determines an amount of paper product remaining on the holder and transmits a status message signal containing a status of the paper product to the master network device.

36. The intelligent dispensing system of claim 17 wherein the local network uses a standard data communications protocol.

37. The intelligent dispensing system of claim 36 wherein the building automation and control network uses a building automation and control network protocol.

38. The intelligent dispensing system of claim 17 further comprising a handheld device for data communications with the master network device.

* * * * *